United States Patent [19]

Tocci

[11] 4,228,937

[45] Oct. 21, 1980

[54] CLEAVING APPARATUS

[75] Inventor: Anthony J. Tocci, North Brunswick, N.J.

[73] Assignee: RCA Corporation, New York, N.Y.

[21] Appl. No.: 25,098

[22] Filed: Mar. 29, 1979

[51] Int. Cl.[3] ..... B26F 3/00

[52] U.S. Cl. ..... 225/96.5; 225/2

[58] Field of Search ..... 225/2, 96.5

[56] References Cited

U.S. PATENT DOCUMENTS

| | | | |
|---|---|---|---|
| 2,839,871 | 6/1958 | Austin | 225/96.5 |
| 3,169,837 | 2/1965 | Moross et al. | 29/183 |
| 3,247,576 | 4/1966 | Dill, Jr. et al. | 29/155.5 |
| 3,715,067 | 2/1973 | Hunsinger et al. | 225/96.5 |
| 3,718,268 | 2/1973 | Insolio | 225/2 |
| 4,018,372 | 4/1977 | Insolio | 225/2 |
| 4,105,150 | 8/1978 | Insolio | 225/96.5 |

*Primary Examiner*—Frank T. Yost

*Attorney, Agent, or Firm*—Birgit E. Morris; Donald S. Cohen; Kenneth R. Glick

[57] ABSTRACT

An apparatus for accurately and precisely cleaving crystalline material comprising a platform having an edge over which a workpiece projects, and a rotatable member having a scribing point and protrusion extending substantially radially therefrom. Upon rotation of the rotatable member, the arcs described by the scribing point and protrusion are substantially parallel to the platform edge, and intersect that portion of the workpiece which projects over the platform edge.

5 Claims, 3 Drawing Figures

CLEAVING APPARATUS

BACKGROUND OF THE INVENTION

The present invention relates to crystallography, and more specifically, to an apparatus for cleaving crystalline materials.

In the semiconductor industry, a monocrystalline wafer of semiconducting or semi-insulating material is commonly used as a substrate material. Many applications, (such as laser diodes), require the fabrication of monocrystalline devices whose physical dimensions are crystallographically perfect, or nearly so. To produce devices of such precise dimension, these monocrystalline materials are often broken along preferred cleavage planes (the [110] planes in gallium arsenide, or the [111] planes in silicon, for example).

Heretofore, a typical method for cleaving wafers was to manually apply a force, concentrated either at a point or along a line, on a major surface of the wafer. This was a time consuming and imprecise operation which often resulted in inaccurate wafer breakage.

SUMMARY OF THE INVENTION

An apparatus for cleaving crystalline material comprising a platform having an edge over which a workpiece projects, and a rotatable member having a scribing point and protrusion extending substantially radially therefrom, and located on a plane which is perpendicular to the axis of rotation of the rotatable member. Upon axial rotation of the rotatable member, the arcs described by the scribing point and protrusion are substantially parallel to the platform edge, and intersect that portion of the workpiece which projects over the edge.

DETAILED DESCRIPTION

Figure 1:
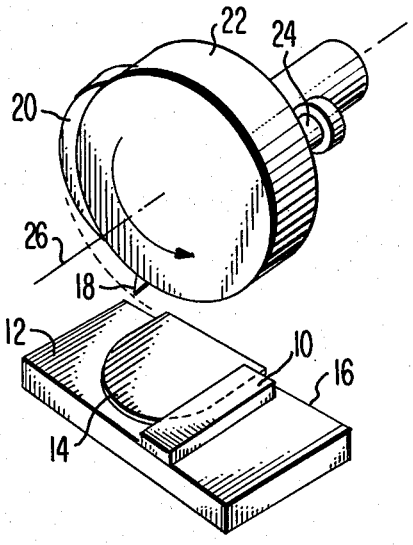
FIG. 1 is a perspective view of a preferred embodiment of the present invention.

Referring to FIG. 1, the basic elements of the preferred embodiment include a platform 12 to which a workpiece 14 is secured, and a rotatable member 22.

The platform 12 has at least one substantially straight edge 16, and a clamp 10 (or an equivalent means) for securing the workpiece 14 to the platform 12 such that a portion of the workpiece overhangs the platform edge 16. The workpiece 14 generally comprises a wafer of monocrystalline semiconducting or semi-insulating material of known crystallographic orientation (for example, with its major surfaces parallel to the [100] plane). The crystal should additionally be oriented such that the desired cleavage planes are essentially parallel to the platform edge 16. For example, the workpiece 14 may typically comprise a 20 mil thick wafer of gallium arsenide (of zinc blende type crystal structure) oriented such that its major surface is parallel to the [100] plane, and the [110] planes are parallel to the platform edge.

The rotatable member 22 (illustrated as a disc, although the invention is not so restricted) is rotatable about axis 26. A scribing point 18 and protrusion 20 extend substantially radially from the surface of the rotatable member 22. A knob 24, for example, is provided as a means for rotating the member 22, although it should be obvious that other manual or machine driven means for rotation are possible as well.

The rotatable member 22 is positioned such that upon rotation, the arcs described by the scribing point 18 and protrusion 20 are essentially parallel to the platform edge 16, and intersect the workpiece 14. The direction of rotation is such that the scribing point intersects the workpiece, followed by the protrusion intersecting the workpiece. In operation, the rotation of the scribing point 18 through the workpiece creates a notch on the leading edge 28 of the workpiece. As the rotation continues (in the indicated direction) the protrusion 20 contacts and applies a bending moment to the workpiece, causing a fracture to propagate from the notch through the length of the workpiece which overhangs the platform edge. Although the apparatus thus described is entirely functional, to further facilitate a predictable cleavage plane fracture, several additional features can be incorporated into the apparatus design, and are more clearly represented in FIGS. 2 and 3.

Figure 2:
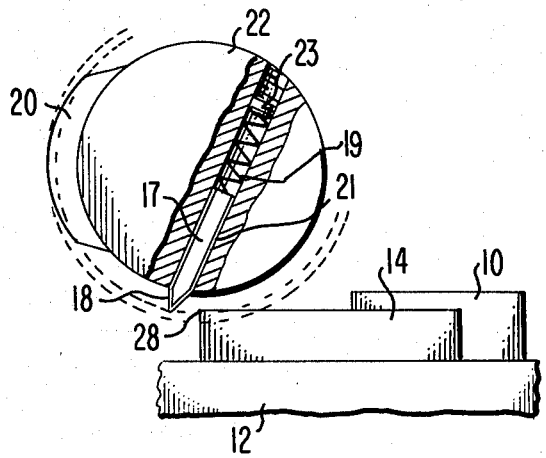
FIG. 2 is a side view of the preferred embodiment.

Referring to FIG. 2, a scribe 17, having the scribing point 18 on an end thereof, is spring-loaded in the rotatable member. This can be accomplished, for example, by utilizing a cylindrical scribe 17 which is slidably mounted in a hole 21 in the rotatable member, and which rests against a spiral compression spring 19 which is anchored in the hole. The spring 19 might be anchored, for example, by a screw 23 in the opposite side of the hole 21 from which the scribing point 18 extends. This spring-loading feature tends to reduce the impact force of the scribing point on the workpiece 14 and therefore creates a more precisely defined notch. Furthermore, it permits greater tolerance when aligning the rotatable member 22 with the platform/workpiece during initial setup of the apparatus.

This view further illustrates the side profile of the protrusion 20. The protrusion profile should be such that upon rotation of the member 22, the protrusion applies a force to the workpiece 14 in a gradual manner. For example, the protrusion can comprise a portion of continuously increasing radius, which leads into a portion of constant radius.

Figure 3:
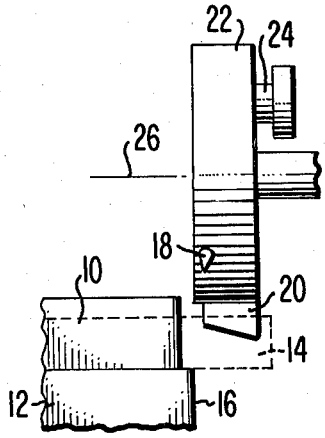
FIG. 3 is an edge view of the preferred embodiment.

Referring to FIG. 3, an end view of the apparatus following a stroke of the rotatable member 22, is shown. It can be seen that the protrusion 20 is canted with respect to the planes of the workpiece and platform. This cant can be considered in terms of the radial distance the protrusion extends from the axis of rotation 26, as a function of the rotatable member to platform edge distance. That is, the cant is such that the minimum radius of the protrusion is at a point closest to the platform edge, and the maximum protrusion radius is at a point displaced from the platform edge. This canted profile of the protrusion 20 provides a greater bending moment to the workpiece (by first applying force at a point displaced from the notch) than would a protrusion of, for example, rectangular end profile.

Other modifications to the apparatus can be performed while still remaining within the scope of the invention. For example, an automated means for indexing the workpiece across the platform, or a more sophisticated rotation means than the illustrated knob 24, can be employed to increase the output rate of the apparatus.

The present invention thus provides an automatic and highly repeatable means for fabricating cleaved crystalline wafers of precise and accurate dimension.

I claim:

1. An apparatus for cleaving crystalline material, comprising:

(a) a platform for supporting the crystalline material thereon, having a substantially straight edge over which the crystalline material projects; and (b) a rotatable member having a scribing point and protrusion extending substantially radially therefrom and located on a plane which is perpendicular to the axis of rotation of the rotatable member, such that upon axial rotation of the rotatable member, the arcs described by the scribing point and protrusion are substantially parallel to the platform edge, and intersect the crystalline material which projects over the edge such that a bending moment is created in that portion of the crystalline material which projects over the platform edge.

2. An apparatus of claim 1, further comprising:

means for attaching the crystalline material to the platform.

3. An apparatus of claim 1, wherein:

the rotatable member is a disc.

4. An apparatus of claim 1, wherein:

the protrusion is canted such that its radius increases as its distance from the platform edge increases.

5. An apparatus of claim 1, wherein:

the scribing point is spring mounted in the rotatable member such that it is urged to return to its original position when it is displaced therefrom.

* * * * *